United States Patent [19]

Pickett

[11] 4,345,398

[45] Aug. 24, 1982

[54] GUN REST

[76] Inventor: Fred E. Pickett, 508 Sophia La., Shreveport, La. 71115

[21] Appl. No.: 158,060

[22] Filed: Jun. 9, 1980

[51] Int. Cl.[3] ..... F41C 29/00

[52] U.S. Cl. ..... 42/94

[58] Field of Search ..... 42/94; 89/37 BA

[56] References Cited

U.S. PATENT DOCUMENTS

| | | | |
|---|---|---|---|
| 1,112,732 | 10/1914 | Uhl | 42/94 |
| 1,497,794 | 6/1924 | Saunders | 42/94 |
| 2,472,804 | 6/1949 | Bird | 42/94 |
| 3,327,422 | 6/1967 | Harris | 42/94 |

FOREIGN PATENT DOCUMENTS

| | | | |
|---|---|---|---|
| 15996 | of 1897 | United Kingdom | 42/94 |

*Primary Examiner*—Charles T. Jordan

[57] ABSTRACT

A gun rest for firearms which is characterized by a monopod having a base cylinder and a plurality of nesting, tapered interior tubes or cylinders, each having a successively smaller diameter and arranged in concentric, normally retracted, telescoping configuration inside the base cylinder. A mount plate is provided with a pivot clamp at one end for pivotal cooperation with the base cylinder, and a monopod clamp at the opposite end for removably securing the opposite end of the base cylinder to the plate. The mount plate is further provided with a pair of upwardly extending barrel clamps mounted in spaced relationship on opposite sides of the plate from the pivot clamp and the monopod clamp, respectively, for removable attachment of the monopod and mount plate to the barrel of a gun or rifle. When not in use the monopod is positioned in essentially parallel, retracted relationship to and beneath the mount plate and the barrel of the firearm. In functional position the monopod is removed from the monopod clamp and pivoted on the pivot clamp to a position essentially perpendicular to the mount plate and gun barrel, with the interior cylinders selectively and telescopically extended from the base cylinder and temporarily locked to provide a secure rest for the firearm.

8 Claims, 5 Drawing Figures

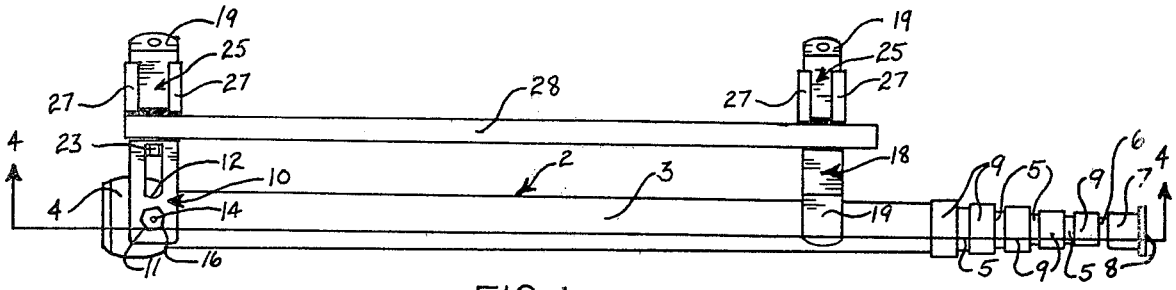
FIG. 1
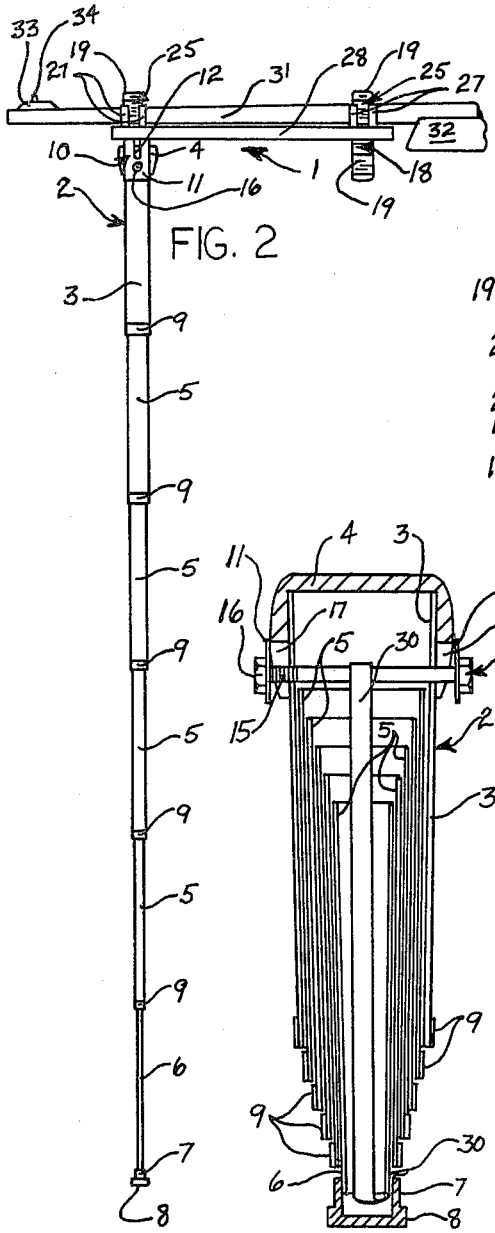
FIG. 2
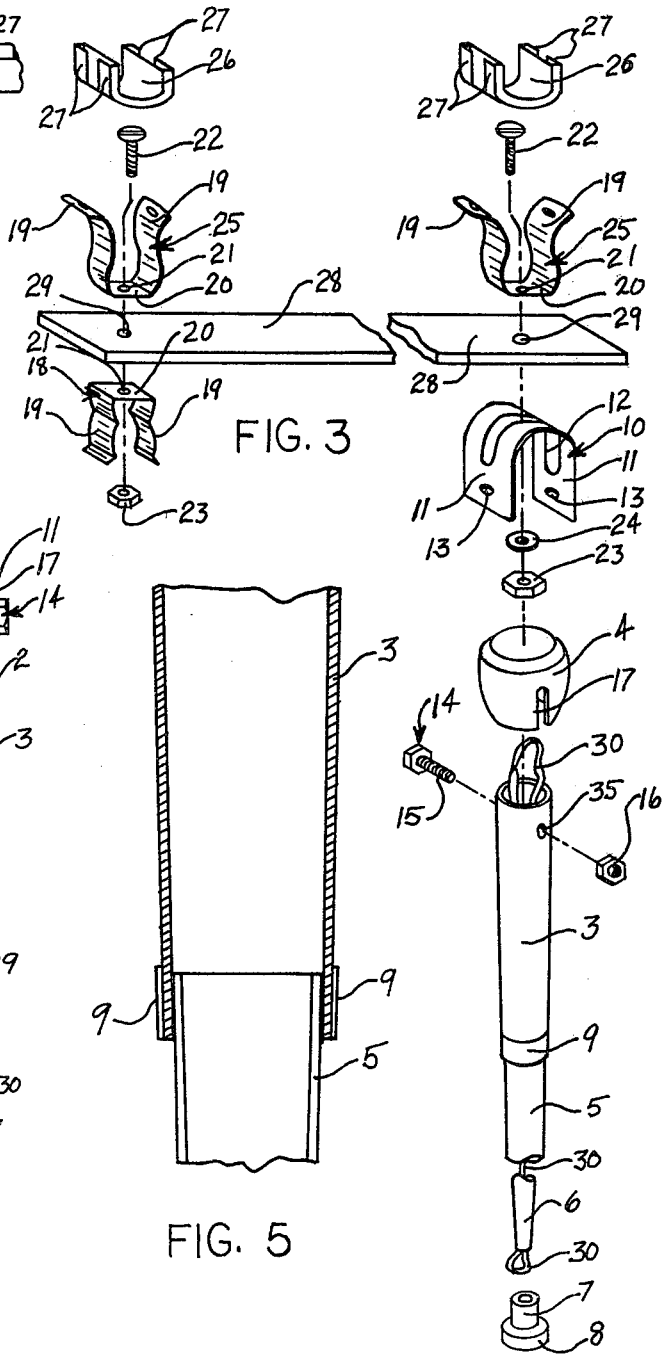
FIG. 3
FIG. 4
FIG. 5

GUN REST

BACKGROUND OF THE INVENTION

1. Field of the Invention

This invention relates to gun rests for firearms, and more particularly, to a gun rest which is normally carried in folded, retracted and telescoping configuration beneath the barrel of a gun or rifle, and which can be quickly and selectively extended to provide a secure rest for the gun or rifle at a selected elevation. The gun rest of this invention is light in weight, compact, normally aligned with and positioned beneath the rifle barrel when not in use, and is capable of quick and easy pivotal and locked extension to provide a rest of selected length with minimum effort. In a preferred embodiment of the invention the concentrically positioned, telescoping tubes are provided with an elastic band to insure prompt and efficient return of the tapered tubes to the retracted position when it is desired to restore the monopod to its non-functional, folded position.

2. Description of the Prior Art

Gun rests of varying description and design have been in existence since the advent of firearms. Perhaps the earliest known rest was a forked stick of selected length used to support the barrel of a gun while aiming and firing. Such rests were known in the Revolutionary War and were, in many instances, considered to be essential equipment for sharp-shooters and snipers during that era. Gun rests were particularly significant and useful during this time period because of the extremely heavy weight of the guns and muskets used, which necessitated either a portable rest or the use of a tree or fence post to support the barrel of the weapon. Typical of the gun rests of an early era is that described in British Pat. No. 15,996 to E. C. Abella, which discloses a gun support having one end hingedly attached to a rifle or gun at a point forward of the trigger guard, and the opposite end secured to the user's belt. The device was designed to telescope and cradle the gun in order to facilitate a steady aim.

Bipod support attachments for weapons are particularly well known in the art. Typical of such supports is the bipod gun mount for military application which is disclosed in U.S. Pat. No. 3,235,997 E. M. Stoner, which device includes a spring-loaded, folding and adjustable bipod mount which is mounted on the front end of a firearm for support in aiming and firing the weapon. Another bipod mount is disclosed in U.S. Pat. No. 3,327,422 to G. Harris, which bipod is adapted for attachment to a firearm. The device includes a chair having a pivoting seat and back and mounted on a base to swing forwardly and upwardly. A link system supported by the seat is provided with a leg rest on the front end, which is disposed beneath the seat when retracted and in parallel relation therewith and with itself in all positions during movement from retracted to extended position.

Most of the gun rests or mounts disclosed in the prior art were designed for military application, with the bipod mounts having specific application to relatively heavy, automatic or semi-automatic weapons designed to be fired while in the prone position. These mounts are characteristically heavy and cumbersome and are generally adjustable only to a limited degree.

Accordingly, it is an object of this invention to provide a new and improved rest for firearms which is adjustable and light in weight, and which may be removably and pivotally mounted on the barrel of substantially any gun or rifle for quick and easy deployment from a compact and convenient non-functional, stored configuration.

Another object of this invention is to provide a new and improved gun rest for substantially any firearm which is characterized by a plurality of light, nested, tapered telescoping members which are biased in normally retracted configuration, and which may be removably and rotatably clamped to the barrel of a firearm for selective, pivotal, downward extension and locking against the bias to provide a steady, efficient and secure rest during aiming and firing of the gun or rifle, and to permit rotation of the gun or rifle barrel in the barrel clamp or clamps when the weapon is sighted on a moving target.

Yet another object of this invention is to provide a new and improved, light-weight gun rest which can be removably mounted on the barrels of guns and rifles of substantially any description, which rest is characterized by a pivoting, telescoping monopod featuring multiple, tapered cylinders or tubes and designed to rest in essentially parallel relationship to and beneath the firearm barrel when not in use, and in deployed configuration, is pivoted downwardly to a position at essentially 90° with respect to the barrel, with the cylinders extended downwardly from a base cylinder in temporarily locked position to provide a steady rest for the firearm.

Yet another object of this invention is to provide a new and improved, light-weight gun rest which is characterized by a telescoping monopod featuring a base cylinder and multiple, tapered interior cylinders, which monopod is pivotally mounted on a frame capable of being removably and rotatably clamped to or mounted on the gun barrel of a firearm to permit rapid downward pivoting of the monopod and extension and locking of the tapered, multiple, concentric cylinders from the base cylinder in the monopod to a selected height in order to provide a rest for secure aiming and shooting of the firearm.

SUMMARY OF THE INVENTION

These and other objects of the invention are provided in a new and improved gun rest for firearms which is characterized by a monopod pivotally mounted to a mount plate or support, which support is in turn removably clamped or otherwise rotatably mounted to the barrel of a gun or rifle, the monopod being further characterized by a plurality of tapered, nesting, concentrically-mounted cylinders provided in biased, normally retracted relationship inside a base cylinder and adapted for selective extension and temporarily locking downwardly of the gun barrel when the base cylinder is pivoted downwardly for support of the barrel during aiming and firing of the rifle.

BRIEF DESCRIPTION OF THE DRAWING

The invention will be better understood by reference to the accompanying drawing, wherein:

FIG. 1 is a side elevation of a preferred embodiment of a gun rest of this invention in normally retracted configuration;

FIG. 2 is a side elevation of the gun rest illustrated in FIG. 1 with the monopod in deployed, extended and locked configuration as a rest to steady a rifle;

FIG. 3 is an exploded view of the monopod illustrated in FIGS. 1 and 2 in pivoted relationship and ready for extension;

FIG. 4 is a sectional view of the gun rest monopod taken along lines 4—4 in FIG. 1; and FIG. 5 is a sectional view of two of the extended cooperating, tapered interior cylinders or tubes forming the monopod.

DESCRIPTION OF THE PREFERRED EMBODIMENTS

Referring now to FIG. 1 of the drawing, the gun rest of this invention is generally illustrated by reference numeral 1, and includes a monopod 2, which is characterized by an outside base cylinder 3, having a cylinder cap 4 at one end and a plurality of tapered, interior tubes or cylinders 5 of varying diameter in concentric, retracted relationship therein. The smallest interior cylinder is designated as rest cylinder 6, and is provided with a rubber boot 7, having a boot flange 8 on the end thereof for contact with the ground when monopod 2 is fully extended. In a preferred embodiment of the invention base cylinder 3 and interior cylinders 5 are provided with cylinder collars 9, which serve to strengthen base cylinder 3 and interior cylinders 5 during extension of the cylinders as illustrated in FIG. 2. In a most preferred embodiment of the invention cylinder collars 9 are metal, and are tightly fitted to the open end of base cylinder 3 and the large ends of interior cylinders 5 to provide the additional strength.

Referring now to FIGS. 1–3 of the drawing and to FIG. 3 in particular, a pivot clamp 10 is mounted on one end of a clamp mount plate 28 by means of a clamp mount bolt 22, registering with one of plate apertures 29, and a cooperating washer 24 and clamp mount nut 23. Pivot clamp 10 is formed in a U-shaped configuration with clamp legs 11 projecting in essentially parallel relationship and provided with apertures 13, as illustrated. A clamp slot 12 is also provided in the body of pivot clamp 10, and extends downwardly into clamp legs 11. A pivot bolt 14, having pivot bolt threads 15, is provided in registration with apertures 13 of pivot clamp 10, and with a cap slot 17 in cylinder cap 4, and in further registration with base cylinder apertures 35 in base cylinder 3 to pivotally secure monopod 2 onto clamp legs 11 of pivot clamp 10 by means of pivot nut 16. A monopod clamp 18 is provided at the opposite end of clamp mount plate 28 from pivot clamp 10 and extending in the same direction as pivot clamp 10 in order to carry the free end of monopod 2 when the monopod is in folded, non-functional configuration, as illustrated in FIG. 1. Clamp fingers 19 of monopod clamp 18 serve to engage base cylinder 3 in monopod 2 and removably secure the monopod in folded configuration beneath, and parallel to the rifle barrel 31. In a preferred embodiment of the invention a pair of barrel clamps 25, positioned on the opposite side of clamp mount plate 28 from pivot clamp 10 and monopod clamp 18, respectively, are mounted to clamp mount plate 28 by inserting clamp mount bolts 22 through clamp apertures 21 in each clamp base 20. Clamp fingers 19 are disposed in spreading, curved relationship on barrel clamp 25, and clamp pads 26, having external pad flanges 27 for engagement with clamp fingers 29, are inserted on barrel clamps 25 in order to securely mount rifle barrel 31 in barrel clamps 25 just forward of grip 32 without scratching the barrel, as illustrated in FIG. 2. It will be appreciated by those skilled in the art that in a most preferred embodiment of the invention barrel clamp 25 can also be coated with rubber or plastic, as desired, in order to secure the rifle barrel 31 in the clamp without scratching the finish on the barrel. Since front sight mount 33 and front sight 34 are mounted on the top center of rifle barrel 31, front sight 34 can easily be aligned with the rear sight (not illustrated) of the rifle between the clamp fingers 19 when the gun rest 1 is placed in position on rifle barrel 31. If the rifle is equipped with a scope, the scope is mounted above the front sight 34, and the sight does not interfere with the gunner's field of vision.

Referring now to FIGS. 2–5, in a preferred embodiment of the invention interior cylinders 5, base cylinder 3 and rest cylinder 6 are tapered from top to bottom as illustrated in FIG. 4, in order to extend and lock, as illustrated in FIGS. 2 and 5. Cylinder collars 9 insure a secure, yet yielding locking of the cylinders in order to facilitate quick and easy extension of a desired number of cylinders from base cylinder 3 to support rifle barrel 31, and subsequent retraction of the cylinders into the base cylinder by upward pressure exerted on the cylinders. This release of the locking function specifically illustrated in FIG. 5 is aided by an elastic band 30, more particularly illustrated in FIGS. 3 and 4, which also serves to maintain interior cylinders 5 and rest cylinder 6 inside base cylinder 3, as illustrated in FIGS. 1 and 4. In a most preferred embodiment of the invention one end of elastic band 30 is attached to the end of rest cylinder 6 by means of boot 7, while the other end is secured to base cylinder 3 on pivot bolt 14.

It will be appreciated by those skilled in the art that the cross-sectional configuration of base cylinder 3, interior cylinders 5 and rest cylinder 6 can be other than cylindrical. For example, the telescoping members may be triangular or square in cross-section, so long as they are provided with a sufficient taper to permit locking as described above. The member cross-section may therefore be generally in the shape of any polygon, although as set forth above, in a most preferred embodiment of the invention the monopod 2 is characterized by a base cylinder 3, interior cylinders 5 and a rest cylinder 6 having a tapered, cylindrical configuration.

Referring again to the drawing, it will be further appreciated that in addition to providing an advantage in steadying the rifle, and rifle barrel 31 in particular, to enable a gunner to achieve greater accuracy, the gun rest 1 also serves to reduce recoil against the gunner's shoulder. This feature is particularly advantageous under circumstances where the rifle in use fires a heavy bullet and recoil is high. The advantage permits the gunner to more quickly align his sights with the intended target for a faster followup shot or shots.

Having described my invention with the particularity set forth above, what is claimed is:

1. A gun rest for supporting a firearm comprising:

(a) a monopod characterized by a tapered base member and a plurality of tapered interior members carried by said base member in telescoping and locking relationship when said interior members are extended;

(b) pivot clamp means carried by one end of said monopod in pivotal relationship;

(c) a clamp mount plate supporting said pivot clamp means and disposed above said monopod;

(d) a monopod clamp means carried by said clamp mount plate and removably engaging said monopod when said interior members are in retracted, telescoped configuration inside said tapered base member; and (e) a pair of barrel clamps mounted on said clamp mount plate for removably positioning said clamp mount plate and said monopod on the barrel of said firearm.

2. The gun rest of claim 1 wherein said tapered base member and said tapered interior members are tapered cylinders in normally retracted, generally concentric relationship.

3. The gun rest of claim 1 wherein said pivot clamp means and said monopod clamp means are mounted to said clamp mount plate in spaced relationship and said barrel clamps are secured to said clamp mount plate in oppositely disposed relationship from said pivot clamp means and said monopod clamp means, respectively.

4. The gun rest of claim 1 wherein:

(a) said tapered base member and said tapered interior members are tapered cylinders in normally retracted, substantially concentric relationship; and (b) said pivot clamp means and said monopod clamp means are mounted to said clamp mount plate in spaced relationship and said barrel clamps are secured to said clamp mount plate in oppositely disposed relationship from said pivot clamp means and said monopod clamp means, respectively.

5. The gun rest of claim 1 further comprising an elastic band having one end attached to said base member and the opposite end attached to the smallest one of said interior members to bias said interior members in retracted configuration inside said base member.

6. The gun rest of claim 1 further comprising an elastic band having one end attached to said base member and the opposite end attached to the smallest one of said interior members to bias said interior members in retracted configuration inside said base member; and wherein:

(a) said tapered base member and said tapered interior members are tapered cylinders in normally retracted, generally concentric relationship; and (b) said pivot clamp means and said monopod clamp means are mounted to said clamp mount plate in spaced relationship and said barrel clamps are secured to said clamp mount plate in oppositely disposed relationship from said pivot clamp means and said monopod clamp means, respectively.

7. The gun rest of claim 1 further comprising a cap means fitted to the end of said base member carrying said pivot clamp and a boot on the smallest end of the smallest one of said interior members to provide a secure contact with a supporting surface when at least one of said interior members is extended from said base member.

8. The gun rest of claim 1 further comprising an elastic band having one end attached to said base member and the opposite end attached to the smallest one of said interior members to bias said interior members in retracted configuration inside said base member; a cap means fitted to the end of said base member carrying said pivot clamp; and a boot on the smallest end of the smallest one of said interior members to provide a secure contact with a supporting surface when at least one of said interior members is extended from said base member; and wherein:

(a) said tapered base member and said tapered interior members are tapered cylinders in normally retracted, generally concentric relationship; and (b) said pivot clamp means and said monopod clamp means are mounted to said clamp mount plate in spaced relationship and said barrel clamps are secured to said clamp mount plate in oppositely disposed relationship from said pivot clamp means and said monopod clamp means, respectively.

* * * * *